US006437263B1

(12) United States Patent
Burgess et al.

(10) Patent No.: US 6,437,263 B1
(45) Date of Patent: Aug. 20, 2002

(54) DRAPE SENSOR

(76) Inventors: Lester E. Burgess, Box 522, Swarthmore, PA (US) 19081; Gary Kovac, 53 Woodland Rd., Sewikley, PA (US) 15143; Richard Lerch, 23 War Admiral La., Media, PA (US) 19063; Shawn Martin, 2100 Sycamore Dr., Harrisburg, PA (US) 17112

( * ) Notice: Subject to any disclaimer, the term of this patent is extended or adjusted under 35 U.S.C. 154(b) by 0 days.

(21) Appl. No.: 09/975,421

(22) Filed: Oct. 11, 2001

(51) Int. Cl.[7] ..... H01H 3/16
(52) U.S. Cl. ..... 200/61.43; 200/61.73
(58) Field of Search ..... 49/26–28; 200/61.41–61.44, 200/61.62, 61.7, 61.71, 61.73, 61.76, 61.81

(56) References Cited

U.S. PATENT DOCUMENTS

| | | | | |
|---|---|---|---|---|
| 3,270,160 A | | 8/1966 | Koenig | 200/86 |
| 3,315,050 A | | 4/1967 | Miller | 200/61.43 |
| 4,051,336 A | | 9/1977 | Miller | 200/61.43 |
| 4,273,974 A | | 6/1981 | Miller | 200/61.43 |
| 4,349,710 A | | 9/1982 | Miller | 200/61.43 |
| 4,785,143 A | | 11/1988 | Miller | 200/61.43 |
| 4,908,483 A | | 3/1990 | Miller | 200/61.43 |
| 4,920,241 A | | 4/1990 | Miller | 200/86 R |
| 5,023,411 A | | 6/1991 | Miller et al. | 200/61.43 |
| 5,027,552 A | | 7/1991 | Miller et al. | 49/27 |
| 5,072,079 A | | 12/1991 | Miller | 200/61.43 |
| 5,589,811 A | * | 12/1996 | Pariot et al. | 200/61.43 |
| 5,856,644 A | * | 1/1999 | Burgess | 200/61.43 |
| 5,920,044 A | * | 7/1999 | Kaji et al. | 200/61.44 |
| 6,281,455 B1 | * | 8/2001 | Plottnik et al. | 200/61.44 |

FOREIGN PATENT DOCUMENTS

| | | | |
|---|---|---|---|
| DE | 1942565 | 3/1971 | |
| DE | 2026894 | 12/1971 | G08B/13/10 |
| EP | 167341 | 10/1986 | H01B/7/10 |
| EP | 293734 | 12/1988 | H01H/3/14 |
| GB | 2045527 | 10/1980 | H01H/13/16 |

* cited by examiner

*Primary Examiner*—Michael Friedhofer
(74) *Attorney, Agent, or Firm*—Dilworth & Barrese, LLP

(57) ABSTRACT

A pressure actuated switching device for free hanging from a horizontal support, such as a drape sensor, includes an outer electrically non-conductive cover having an exterior surface, an interior surface, and a bottom edge portion. A plurality of weep holes are disposed along the bottom edge for drainage of moisture which may condense in the interior of the device. The device also includes a first electrically conductive coating deposited on the interior surface of the cover sheet, an interior sheet having at least a first surface with a second electrically conductive coating deposited thereon, and an electrically non-conductive spacer disposed between the first electrically conductive coating and the second electrically conductive coating. The non-conductive spacer preferably possesses a plurality of zig-zag shaped ribs. The pressure actuated switching device includes a sensitizing bracket to laterally direct forces applied to its side, and tolerates extreme conditions of moisture, heat and cold.

26 Claims, 4 Drawing Sheets

DRAPE SENSOR

BACKGROUND

1. Field of the Disclosure

The present invention relates to a pressure actuated sensor which serves as a switching device, for example, for activating and/or shutting down or controlling mechanical doors, equipment or machinery.

2. Description of the Related Art

Pressure actuated switches are known in the art. Such switches are used for example as safety mats, sensitive door edges, and the like. Typically, such switches include two spaced apart conductors. When pressure is applied the conductors contact each other, thereby closing an electrical circuit. This switching action can be used to activate or, alternatively, deactivate machinery. For example, on mechanically operated doors, the doors commonly include a sensitive edge switch. Should the edge switch make contact with an object in its path (e.g. a person) while the door is closing the edge switch will send a signal to a control unit to reverse or stop the movement of the door. Such edge switches may commonly be found on garage doors, train doors, and the like.

For example, U.S. Pat. No. 5,072,079 to Miller discloses a sensing edge causing a closing door to open by actuating a device upon force being applied to the sensing edge. The sensing edge includes a first sheet of resiliently compressible material, a first sheet of electrically conductive material, a layer of non-conductive material, a second sheet of electrically conductive material, a second sheet of resiliently compressible material and an elongate inner core arranged in the recited order. The inner core has a predetermined elastic compressibility which is selected in accordance with the desired sensitivity of the sensing edge, such that the sensitivity of the sensing edge directly corresponds to the elastic compressibility of the inner core. The first and second sheets of flexible, electrically conductive material are spaced apart by the layer of non-conductive material and present opposed portions to each other through an opening in the layer of non-conductive material whereby upon the application of force to the sheath, the inner core compresses until its elastic compressibility is less than the elastic compressibility of said first and second layers of resiliently compressible material and said layer of non-conductive material, whereupon a portion of the first sheet of flexible, electrically conductive material deflects into the opening in the second layer of non-conductive material and into contact with a portion of the second sheet of flexible, electrically conductive material to thereby actuate the device.

Other edge switches are disclosed, for example, in U.S. Pat. Nos. 5,027,552; 5,023,411; 4,920,241; 4,908,483; 4,785,143; 4,349,710; 4,273,974; 4,051,336; and 3,315,050.

While prior known edge switches are useful for detecting the presence of an object in the path of a moving door, being fully on or completely off they do not discriminate between the signals resulting from contact of the edge switch with large objects, and spurious signals resulting from, for example, disparities in the interfacing surfaces of the switch caused by uneven extrusion.

A freely hanging drape sensor which can distinguish between weak and strong activation of the sensor is disclosed in U.S. Pat. No. 5,856,644 to Burgess, and which is incorporated by reference herein in its entirety. The drape sensor disclosed in U.S. Pat. No. 5,856,644 includes a piezoresistive cellular material and a standoff layer for providing an analog signal correlated with the strength of the activation force, as well as an on-off function. The drape sensor can be used in conjunction with moving objects, such as electrically operated doors to provide safety door edges. Alternatively, the drape sensor can be used as a freely hanging curtain to detect objects moving into contact therewith.

One problem which can occur with drape sensors is internal condensation of moisture. This problem can occur when the drape sensor is positioned between a hot, moist environment on one side and a cold environment on the other side. While the polymeric outer covering of the drape sensor is non-porous and relatively impervious to water in the liquid state, there is nevertheless the possibility of molecular diffusion of water vapor through the polymer cover and into the interior of the sensor. The water vapor can condense inside the drape sensor, thereby affecting its operation if a sufficient amount of water accumulates.

The prevention of water related inconsistencies of operation, as well as other improvements, are provided by the drape sensor described herein.

SUMMARY

A pressure actuated switching device for free hanging from a support, i.e., a drape sensor, is provided herein. The pressure actuated switching device includes: (a) an outer electrically non-conductive cover having an exterior surface, an interior surface, and a bottom edge, wherein the cover includes a plurality of weep holes disposed along the bottom edge; (b) a first electrically conductive coating deposited on the interior surface of the cover sheet; (c) an interior sheet having at least a first surface with a second electrically conductive coating deposited thereon; and (d) an electrically non-conductive spacer disposed between the first electrically conductive coating and the second electrically conductive coating.

Also included is at least one sensitizing bracket for promoting a sensitive response to the application of lateral or bottom applied force. The drape sensor is responsive to actuation along its sides, as well as along the bottom edge. Moreover, the drape sensor functions in extreme conditions of moisture, and hot and cold ambient conditions.

BRIEF DESCRIPTION OF THE DRAWINGS

Various embodiments are described below with reference to the drawings wherein.

DETAILED DESCRIPTION OF PREFERRED EMBODIMENTS

Figure 1:
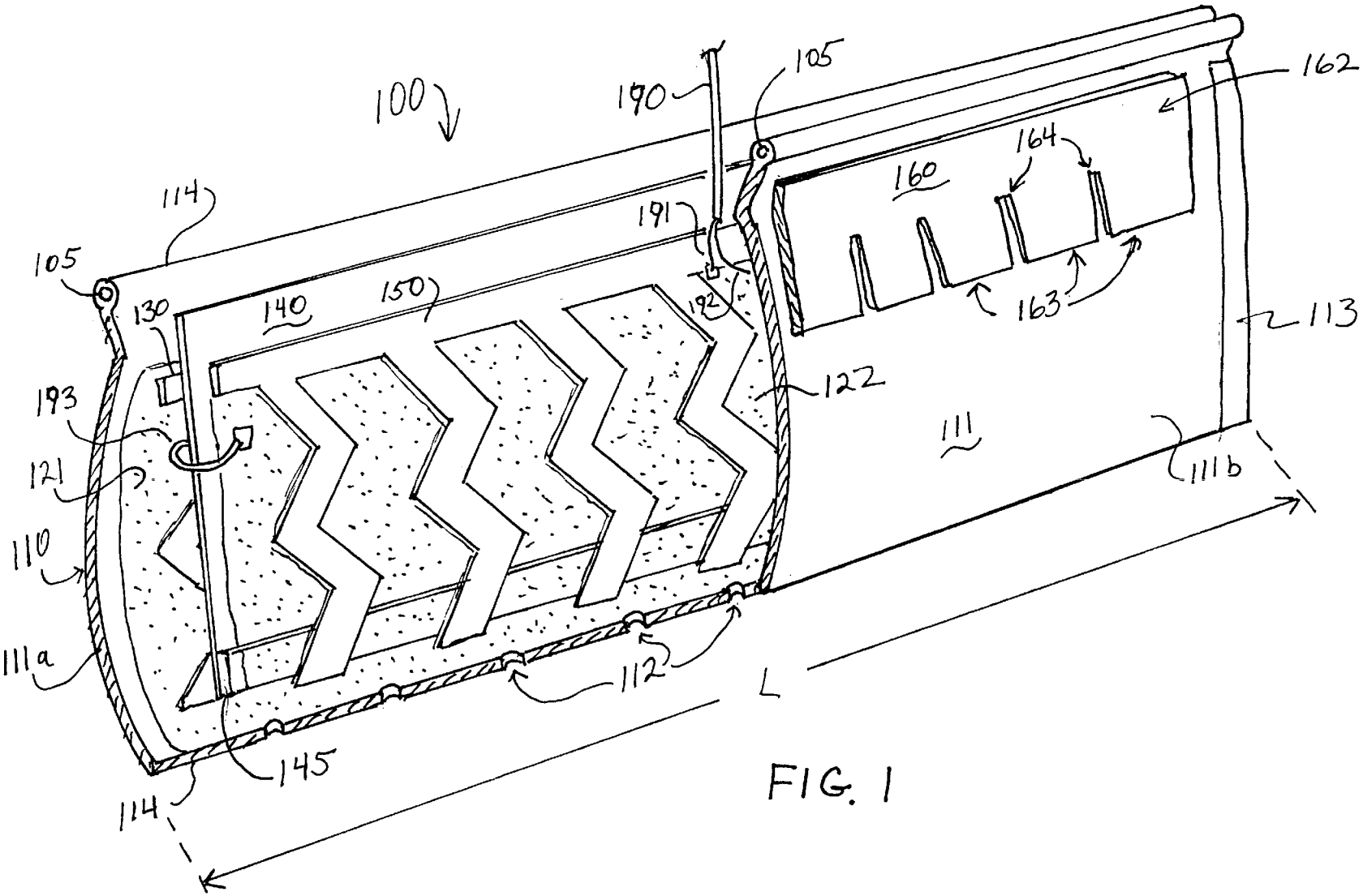
FIG. 1 is a partly cut away perspective view of the drape sensor.

The present invention is directed to a pressure actuated switching device which is advantageously adapted to hang freely and flaccidly from a support, e.g., a drape sensor. The drape sensor can be attached to the leading edge of a motorized movable door, especially a high speed door movable in the vertical direction such as a garage door, hangar door, warehouse or factory door, etc. If the sensor encounters an object in the path of the closing door a signal can be sent to the controller to halt or reverse movement of the door. Moreover, the drape sensor responds to side activation. Alternatively, the drape sensor can be hung from the horizontal lintel of a door frame or other opening to detect objects or persons moving into contact with the drape sensor.

As used herein, percentages of composition is by weight unless stated otherwise. Except for the claims, all quantities specified herein shall be understood to be modified by the term "about".

The terms "insulating", "conducting", "resistance", and their related forms are used herein to refer to the electrical properties of the materials described, unless otherwise indicated. The terms "top", "bottom", "above", and "below", are used relative to each other. The terms "elastomer" and "elastomeric" are used herein to refer to material that can undergo at least 10% deformation elastically. Typically, "elastomeric" materials suitable for the purposes described herein include polymeric materials such as elastomeric plastics such as PVC, polyurethane and natural and synthetic rubbers and the like. As used herein the term "piezoresistive" refers to a material having an electrical resistance which decreases in response to compression caused by mechanical pressure applied thereto in the direction of the current path. Such piezoresistive materials typically are resilient cellular polymer foams with conductive coatings covering the walls of the cells. "Resistance" refers to the opposition of the material to the flow of electric current along the current path in the material and is measured in ohms. Resistance increases proportionately with the length of the current path and the specific resistance, or "resistivity" of the material, and it varies inversely to the amount of cross sectional area available to the current. The resistivity is a property of the material and may be thought of as a measure of (resistance/length) x area. More particularly, the resistance may be determined in accordance with the following formula:

$$R=(\rho L)/A \quad \text{(I)}$$

where

R=resistance in ohms

ρ=resistivity in ohms-inches

L=length in inches

A=area in square inches

The current through a circuit varies in proportion to the applied voltage and inversely with the resistance, as provided in Ohm's Law:

$$I=V/R \quad \text{(II)}$$

where

I=current in amperes

V=voltage in volts

R=resistance in ohms

Typically, the resistance of a flat conductive sheet across the plane of the sheet, i.e., from one edge to the opposite edge, is measured in units of ohms per square. For any given thickness of conductive sheet, the resistance value across the square remains the same no matter what the size of the square is. In applications where the current path is from one surface to another of the conductive sheet, i.e. in a direction perpendicular to the plane of the sheet, resistance is measured in ohms.

Referring now to FIG. 1, drape sensor 100 includes an outer cover 110 having a conductive film 121 on an interior surface, an interior sheet 140 with a second conductive film 122 deposited thereon, and at least one spacer 130 for spacing apart the first and second conductive coatings.

More particularly, cover 110 includes a sheet of polymeric material which preferably has been folded to form a U-shaped structure having two flap portions 111*a* and 111*b* joined at a linear bend forming a bottom edge 114 which defines a lengthwise extension of the drape sensor 100. Vertical side end edges 113 of the flap portions 111*a* and 111*b* can be hermetically sealed by any suitable method.

Cover 110 can be fabricated from any suitable flexible material such as polymer sheet. A preferred material of construction for cover 110 is a sheet of plasticized polyvinyl chloride (PVC) preferably reinforced with polyester fabric. The cover is preferably impervious to 1water. However, under certain conditions such as a hot moist environment on one side of the drape sensor and a cold environment on the other side of the drape sensor, a significant amount of moisture as water vapor can be transported through the cover 110 by molecular diffusion and: can condense in the interior of the drape sensor. The condensed water build-up can puddle and short out the sensor.

Accordingly, a feature of the present invention is that cover 110 includes a plurality of weep holes 112 extending 20 along bottom edge 114. Weep holes 112 permit water which has condensed inside the drape sensor 110 to drain out the bottom so as to avoid excess accumulation of liquid.

The interior surface of cover 110, and preferably of both flaps 111*a* and 111*b*, includes a first conductive electrode film 121, which is formed by applying an elastomeric conductive coating material. The coating material is preferably applied as a fluid by any suitable application method such as spraying, brushing, painting, rolling, silk screening, rotogravure, offset printing, and the like, and then dried to form a conductive film which serves as an electrode.

A preferred composition for the conductive coating material includes a binder such as a polymeric resin, e.g., polyurethane, a conductive filler such as finely powdered metal (e.g., copper, silver, gold, zinc, aluminum, nickel, silver coated copper, silver coated glass, silver coated aluminum), graphite or carbon (e.g., carbon black), and optionally a diluent or solvent. The solvent can include organic compounds either individually or in combination, such as ketones (e.g., methylethyl ketone, diethyl ketone, acetone), ethers (e.g., tetrahydrofuran), esters (e.g., butyl acetate), alcohols (e.g., isopropanol), hydrocarbons (e.g., toluene, xylene, naphtha) or any other liquid capable of dissolving the selected binder. Water can be used as a diluent for aqueous systems, optionally with a surfactant. Exemplary formulations for the conductive coating material are given below in Tables I and II:

TABLE I

Organic Solvent System
(Composition in parts by weight)

| | Broad Range | Preferred Range |
|---|---|---|
| Binder | | |
| Polyurethane thermoplastic elastomeric resin (28.9% solids in tetrahydrofuran) | 1–5 | 2–4 |
| Conductive Filler | | |
| Silver pigment | 5–9 | 6–8 |
| Solvent | | |

TABLE I-continued

| Organic Solvent System (Composition in parts by weight) | Broad Range | Preferred Range |
|---|---|---|
| Methylethyl ketone | 20–300 | 30–100 |

TABLE II

| Aqueous System (Composition in parts by weight) | Broad Range | Preferred Range |
|---|---|---|
| Binder | | |
| Polyurethane thermoplastic elastomeric resin (40% solids in an aqueous emulsion or latex) | 2–10.7 | 4–8 |
| Conductive Filler | | |
| Silver pigment | 5–9 | 6–8 |
| Diluent | | |
| Deionized water (with surfactant) | 20–300 | 30–100 |

Figure 2:
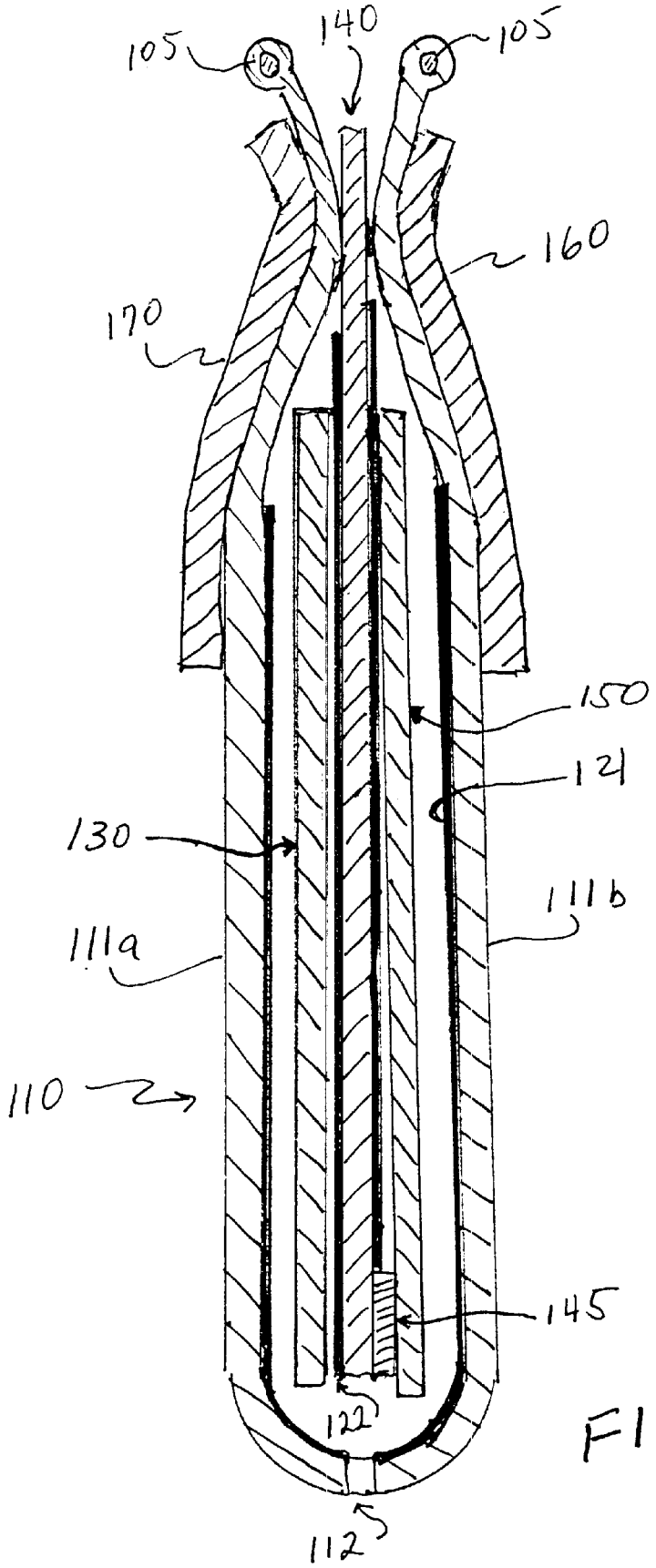
FIG. 2 is a sectional side view of the drape sensor.

Referring now to FIGS. 1 and 2, interior sheet 140 is preferably fabricated from a flexible polymeric material such as plasticized polyvinyl chloride, and is coated on at least one, and preferably both of two opposite sides, with a second conductive electrode film 122, which includes the components set forth above with respect to first conductive electrode film 121. Preferably, a bar 145 is attached to the interior sheet 140 lengthwise along the bottom edge of the interior sheet. Bar 145 stabilizes the bottom edge of the interior sheet against curling or warping and can be fabricated from any relatively stiff material such as plastic, rubber or metal.

Standoff 130 is positioned between flap portions 111*a* and interior sheet 140, electrically separating the portion of the first conductive electrode film 121 deposited on the interior surface of side flap 111*a* and the portion of the second conductive electrode film 122 deposited on a first side of the interior sheet 140. Standoff 150 is positioned between flap portion 111*b* and interior sheet 140, separating the portion of the first conductive electrode film 121 deposited on the interior surface of side flap 111*b* and the portion of the second conductive electrode film 122 deposited on a second side of the interior sheet 140. The standoffs, or spacers, 130 and 150 serve as non-conductive spacers to maintain a gap between the first and second conductive electrode films when the drape sensor is in the unactuated condition.

Figure 3:
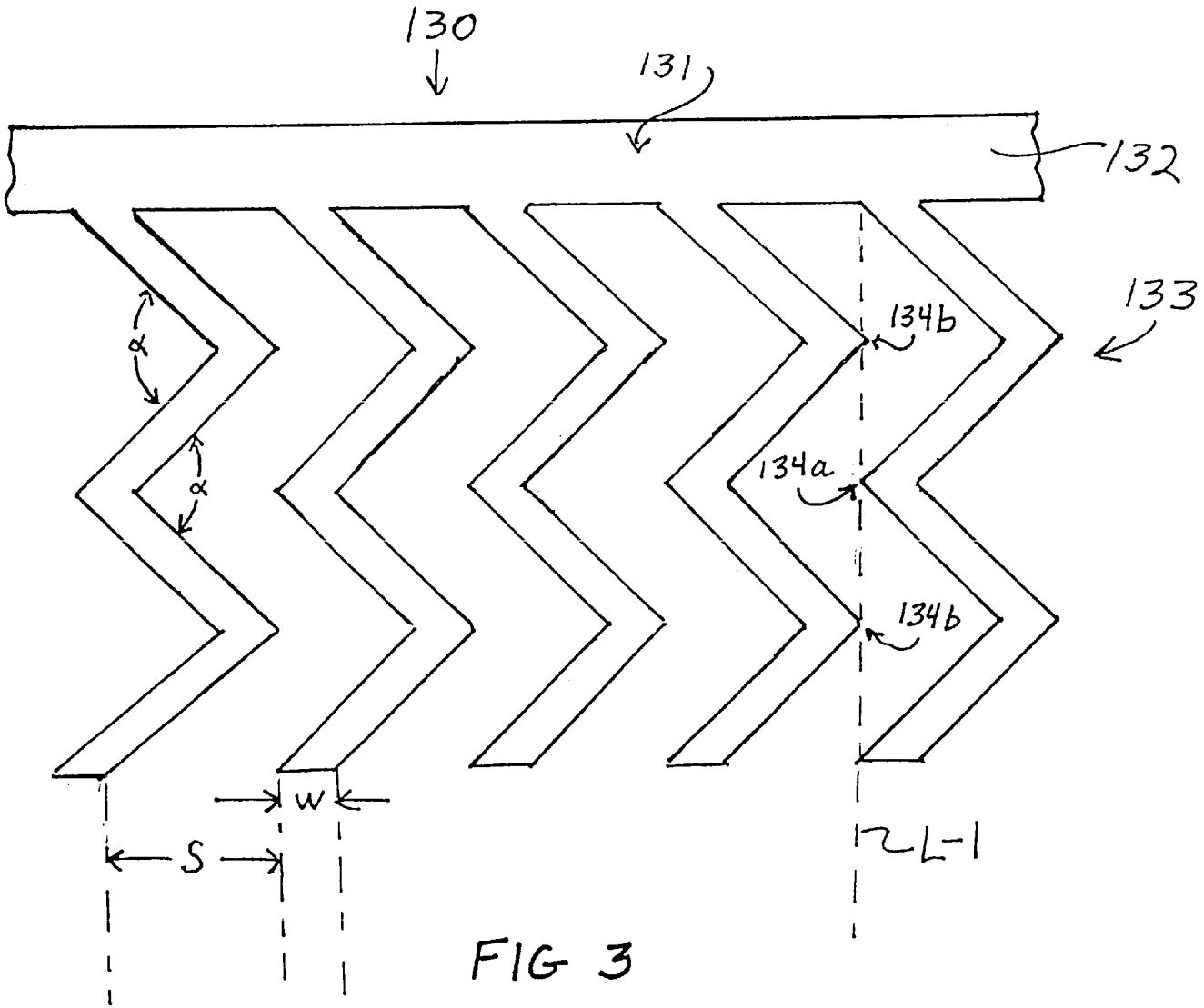
FIG. 3 illustrates a standoff for use in the drape sensor.

Referring now to FIG. 3, standoff 130 is a sheet 131 of resilient, flexible insulative material such as neoprene, plasticized PVC, natural or synthetic rubber and the like. Sheet 131 includes a spine portion 132 extending longitudinally along the length of the drape sensor 100, and a plurality of zig-zag shaped ribs 133 extending downwardly from the spine 132. The shape and configuration of the ribs provide significant advantages to drape sensor 100. The ribs are configured to define alternating corners having an angle a of from between about 60° and 120°, more preferably from 80° to 100°, and most preferably from 85° to 95°. Optimally, the corner points of one rib (e.g. apexes 134*b* and the opposing corner points of the neighboring rib (e.g. apex 134*a*), should define a straight line which preferably vertically descends from spine 132 in a direction perpendicular to spine 132, as illustrated, for example, by line L-1. The ratio of the width W of the ribs to the space S between ribs preferably ranges from 1 to 10, more preferably from 1 to 8, and most preferably from 1 to 4. When the drape sensor is actuated by a lateral force of sufficient magnitude to the cover 111, the first conductive electrode film 121 is moved between the space between the ribs 133 to make contact with the second conductive electrode film 122 and thereby close the electrical circuit to which the drape sensor 100 is connected.

The sensitivity of the drape sensor can be regulated during production by selecting a suitable thickness for sheet 131, the sensitivity of drape sensor 100 to actuation being inversely correlated with the thickness of standoff sheet 131. The preferred thickness for standoff sheet 131 ranges from about 0.125 inches to about 0.010 inches, more preferably from about 0.075 inches to about 0.040 inches. The. elastomeric characteristics of the standoff material should be in the Shore A hardness range of from about 30 to 110.

Standoff 150 is preferably the same as standoff 130 and the description about with respect to standoff 130 applies as well to standoff 150.

Referring again to FIGS. 1 and 2, the drape sensor 100 further includes at least one, and preferably two sensitizing brackets 160 and 170, each sensitizing bracket (160 and 170) extending longitudinally along the outside surface of cover 110 in the vicinity of the top edge of the drape sensor 100. This configuration relies on the angular bonding of the sensitizing bracket near the top.

Sensitizing bracket 160 includes a strip 161 of flexible material which is relatively more stiff than the cover 110. Strip 161 can be fabricated from, for example, neoprene or PVC and is preferably thicker than cover sheet 110.

Strip 161 includes a longitudinally extending portion 161, and a plurality of finger-like projections 163 which depend vertically from portion 162. Preferably projections 163 are spaced apart from each other by gaps 164. Sensitizing bracket 170 is similar to sensitizing bracket 160.

Upon application to the drape sensor of a lateral force sufficient to deflect the drape sensor from a vertical position, sensitizing brackets 160 and 170 facilitate flexing of the pressure actuated switching device 100 along a line defined by the bottom edges of the sensitizing brackets where such flexure would cause contact between first and second conductive electrode films 121 and 122. Thus, the sensitizing brackets 160 and 170 permit greater angular deviation from the vertical orientation of the lower portion of the drape sensor than the upper portion in response to a laterally applied actuation force, the bottom edge of the sensitizing brackets delimiting the lower portion of the drape sensor. By providing stiffness at the upper portion of the drape sensor, sensitizing brackets 160 and 170 help prevent non-actuating flexure of the pressure actuated switching device above the top edges of first and second conductive electrode films 121 and 122. For example, a laterally directed force applied to the side of the drape sensor might have a tendency to simply tilt the entire sensor, which might not cause the drape sensor to be actuated. By causing the drape sensor to bend along a line defined by its bottom edge, the sensitizing bracket facilitates the contacting of the first and second conductive electrode films 121 and 122.

Figure 4:
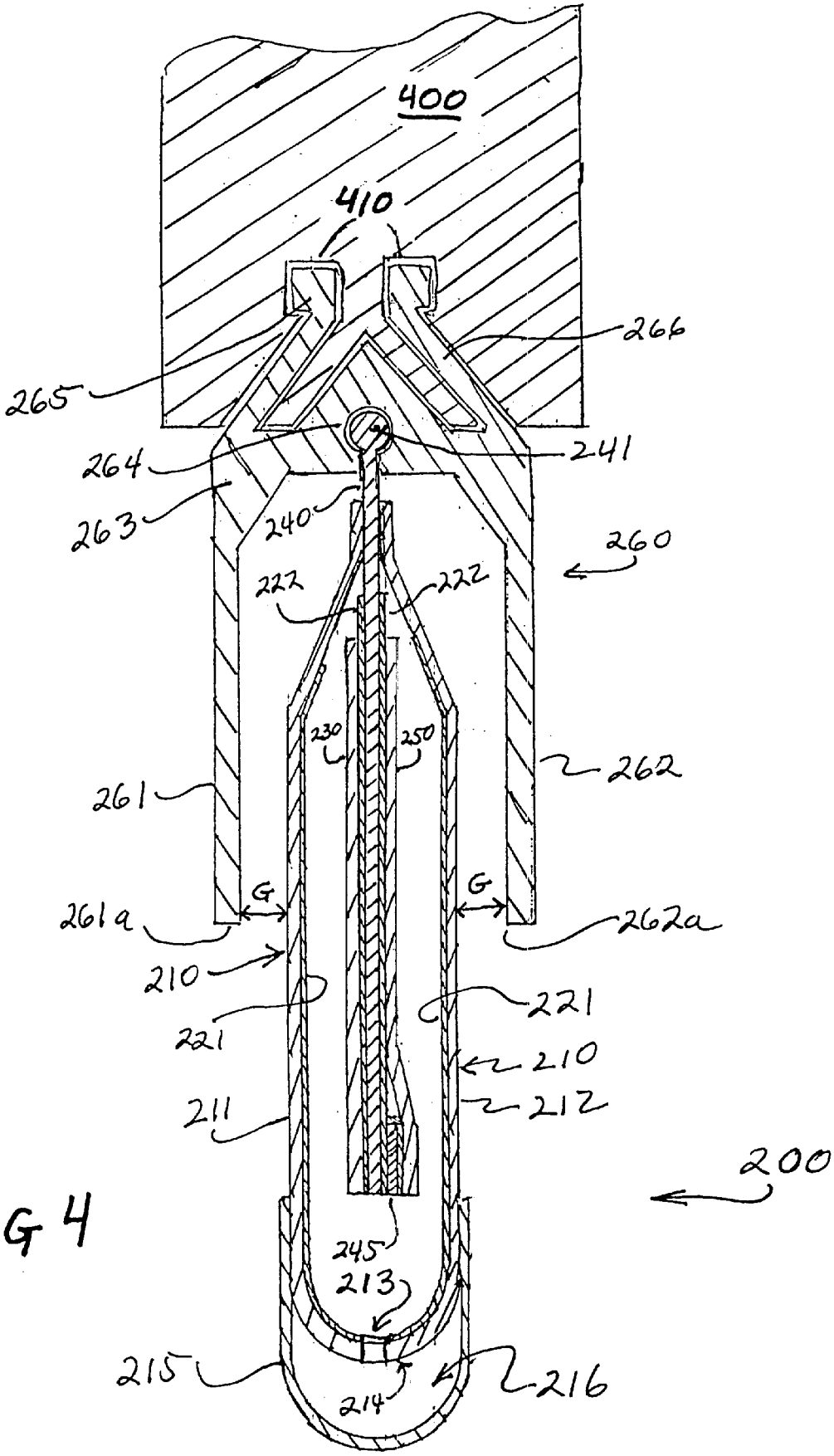
FIG. 4 is a sectional side view of an alternative embodiment of the drape sensor in conjunction with a mounting fixture.

Referring now to FIG. 4, an alternative embodiment 200 of the pressure actuated switching device is illustrated in conjunction with a mounting bracket. Pressure actuated switching device 200 includes a cover 210 comprising flaps 211 and 212 which are folded to form a bottom edge 214. Bottom edge 214 includes a plurality of weep holes 213 therealong. The inside surface of the cover 220 includes a first conductive electrode film 221 deposited thereon by, for example, a coating process and material such as described above. Interior sheet 240 hangs vertically downward from bracket 260 by means of a rod 241 which can be removably inserted into channel 264 of the bracket 260.

The opposite surfaces of interior sheet 240 include a second conductive electrode film 222 deposited thereon. Standoffs 230 and 250 are positioned on opposite sides of the interior sheet 240. A bar 245 extends along the bottom edge of interior sheet 240 to prevent curling or warping.

A flexible pendent sheet 215, preferably fabricated from the same material as the cover 210, is attached to the bottom portion of cover 210 so as to form a U-shaped drainage trough defining an interior chamber 216 beneath the bottom edge 214 of the cover. Pendant sheet 215 serves to prevent tramp contaminated water which comes from rinsing or other sources from spreading through the weep holes into an inner space of the sensor. Chamber 216 serves as a conduit to carry condensed water dripping through weep holes 213 to one or both ends of the pressure actuated switching device 200. The water can thereafter be removed by a drainage tube or other suitable means.

Bracket 260 is preferably fabricated from a relatively stiff elastomeric material which can be, for example, a rubber or a polymer such as, e.g., PVC, polyurethane, polycarbonate, acrylic, etc., or metal, such as, e.g., aluminum, steel, brass, etc. Bracket 260 includes at least one, and preferably two depending legs 261 and 262, one leg on each of the opposite sides of the pressure actuated switching device 200. Legs 261 and 262 serve as sensitizers to facilitate actuation of the pressure actuated switching device 200 when the device has been angularly displaced from the vertical orientation by a certain minimum amount. As can be seen, the bottom edges 261*a* and 262*a* are spaced apart from the outer surface of the cover 210 by a gap G. The smaller the gap G, the less angular displacement is necessary to achieve actuation of the pressure actuated switching device 200.

Bracket 260 includes a channel 264 for receiving rod 241. Bracket 260 further includes prongs 265 and 266 for engagement with a mounting fixture 400.

Mounting fixture 400 can be fixedly attached to or can comprise the bottom edge of a movable door, the lintel of a doorway or window, or any horizontal beam or surface from which the pressure actuated switching device may be hanged.

It should be understood that many different mounting arrangements may alternatively be employed and the particular engagement configuration of mounting fixture and sensitizing bracket shown in FIG. 4 is merely exemplary of one suitable embodiment.

Referring to FIG. 1, electrical connections are preferably made via cable connector 190 disposed through the upper portion of the drape sensor 100 which includes wire leads 191 and 192 between the first and second conductive electrode films 121 and 122 and respective terminals in an electrical circuit for controlling the operation of some equipment or simply monitoring the activation of the pressure actuated switching device. A wire connector 193 extends from the second conductive film 122 on one side of interior sheet 140 to the second conductive electrode film 122 on the opposite side of the interior sheet 140 to electrically connect the two sides. Suitable means of electrical connection and suitable electrical circuitry are within the purview of those with skill in the art.

The pressure actuated switching devices described above may be made in accordance with the following procedure.

The outside cover is cut to shape and weep holes are punched into it in a longitudinal line in proximity to the center of the cover. An electrode area is outlined by a mask and the conductive electrode coating is applied by, for example, spraying, to achieve a conductive electrode film with an electrical resistance of no more than about 5 ohms per square. A drainage trough sheet is cut and bonded to the longitudinal outside center area of the cover. The inside electrode assembly is prepared by coating the interior sheet (e.g., 240) with a second conductive electrode film on both sides and bonding the stiffener bar (e.g., 245) to the bottom edge. A resistor of about 10K ohms is preferably installed between the first and second conductive electrode films to enable the electronic control system to determine and indicate the functional state of the pressure actuated switching device. The zigzag-shaped standoffs are cut from flexible but solid neoprene or other suitable material and bonded to the inside electrode assembly, one standoff to each side. The electrical terminations are installed. The inside electrode assembly with standoffs is positioned in conjunction with the cover and the cover is folded up to enclose in inside electrode assembly. The edges of the device are then thermally bonded. to form a hermetic seal where bonded. The device may then be assembled with a sensitizing bracket, as shown in FIG. 4, or flat sensitizing brackets may be bonded to the sides of the outer cover as shown in FIGS. 1 and 2.

The drape sensor 100 functions well in an environment of extreme temperature conditions and moisture. For example, the drape sensor 100 can serve as a partition between an atmosphere of high heat and humidity (e.g., 100% humidity and temperatures over 100° F.), and an atmosphere of freezing temperature (e.g., below 32° F.). The drape sensor can be splashed with water and can still function without shorting.

While the above description contains many specifics, these specifics should not be construed as limitations on the scope of the invention, but merely as exemplifications of preferred embodiments thereof. Those skilled in the art will envision many other possibilities within the scope and spirit of the invention as defined by the claims appended hereto.

What is claimed is:

1. A pressure actuated switching device for free hanging from a support, which comprises:

a) an outer electrically non-conductive cover having an exterior surface, an interior surface, and a bottom edge portion, wherein said cover includes a plurality of weep holes disposed along the bottom edge;

b) a first electrically conductive coating deposited on the interior surface of the cover;

c) an interior sheet having at least a first surface with a second electrically conductive coating deposited thereon; and d) an electrically non-conductive spacer disposed between the first electrically conductive coating and the second electrically conductive coating.

2. The device of claim 1 wherein the bottom edge of the cover is a fold line formed by folding a sheet of a cover material to at least partially define and at least partially enclose an interior space.

3. The device of claim 1 wherein the bottom edge of the cover is a seam formed by joining at least two sheets of a cover material, said at least two sheets of said cover material at least partially defining and at least partially enclosing an interior space.

4. The device of claim 2 wherein the interior sheet is disposed within said interior space, said interior sheet having a second surface opposite the first surface, the second surface having a third electrically conductive coating deposited thereon.

5. The device of claim 4 wherein the third electrically conductive coating on the second surface of the interior sheet is electrically connected to the second electrically conductive coating on the first surface of the interior sheet.

6. The device of claim 1 wherein the cover comprises a sheet of polyvinyl chloride.

7. The device of claim 6 wherein the sheet of polyvinyl chloride is fabric reinforced.

8. The device of claim 1 wherein the spacer comprises a cellular polymeric foam material.

9. The device of claim 1 wherein the spacer is a flexible sheet of polymeric material.

10. The device of claim 1 wherein the spacer includes a sheet of insulative material having a lengthwise portion and a plurality of spaced apart legs extending from the lengthwise portion, said legs being configured in a zig-zag pattern.

11. The device of claim 1 wherein the weep holes each have a diameter ranging from about 1/32 inch to about ½ inch.

12. The device of claim 1 wherein the pressure actuated switching device has a length, an upper portion and a lower portion and wherein said pressure actuated switching device further includes sensitizing means for permitting greater angular deviation from a vertical orientation of the lower portion than of the upper portion in response to an actuation force of sufficient magnitude applied laterally to a side of the pressure actuated switching device.

13. The device of claim 12 wherein said sensitizing means comprises at least one bracket extending lengthwise along the upper portion of the pressure actuated switching device in the vicinity of the exterior surface of the cover.

14. The device of claim 13 wherein the bracket includes a bracket bottom edge to facilitate the bending of the pressure actuated switching device long a fold line defined by said bracket bottom edge upon application of the actuation force.

15. The device of claim 14 wherein the bracket is fixedly attached to the outer surface of the cover.

16. The device of claim 15 wherein the bracket comprises a longitudinally extending strip having a plurality of spaced finger-like projections extending downwardly therefrom.

17. The device of claim 15 wherein the bracket is fixedly attached to a door.

18. The device of claim 15 wherein the bracket is fabricated from a material selected from the group. consisting of polyvinyl chloride and neoprene.

19. The device of claim 14 wherein the bracket is fabricated from a material selected from the group consisting of metal, wood and plastic.

20. The device of claim 1 wherein the pressure actuated switching device is attached to and freely hangs from a leading edge of a movable door.

21. The device of claim 1 wherein the pressure actuated switching device is attached to a horizontal lintel of a frame for an opening .

22. The device of claim 1 wherein the interior sheet has a length and a lengthwise extending bottom edge portion, and a stiffening member attached to and extending lengthwise along said bottom edge portion.

23. The device of claim 22 wherein the stiffener comprises a strip of material selected from group consisting of elastomeric polymeric resin and metal.

24. The device of claim 1 further comprising a drainage trough positioned beneath the bottom edge of the cover.

25. The device of claim 1 wherein the first and second electrically conductive coatings are elastomeric.

26. The device of claim 1 mounted to a passageway and serves as a partition between an atmosphere of 100% humidity and temperatures above 100° F. on one side and an atmosphere of below 32° F. temperature on another side.

* * * * *